US005639220A

United States Patent [19]

Hayakawa

[11] Patent Number: 5,639,220

[45] Date of Patent: Jun. 17, 1997

[54] PUMP WITH INLET AND OUTLET SIMULTANEOUSLY EXPOSED TO PUMP CHAMBER AND METHOD OF OPERATING SAME

[75] Inventor: Kiyoharu Hayakawa, Ama-gun, Japan

[73] Assignee: Brother Kogyo Kabushiki Kaisha, Nagoya, Japan

[21] Appl. No.: 516,212

[22] Filed: Aug. 17, 1995

[30] Foreign Application Priority Data

Sep. 9, 1994 [JP] Japan ..... 6-215548

[51] Int. Cl.[6] ..... F04B 7/04; F04C 2/063

[52] U.S. Cl. ..... 417/53; 417/488

[58] Field of Search ..... 417/488, 53, 498

[56] References Cited

U.S. PATENT DOCUMENTS

| | | | |
|---|---|---|---|
| 1,232,256 | 7/1917 | Evans | 417/488 |
| 1,274,884 | 8/1918 | Hudson | 417/488 |
| 1,516,032 | 11/1924 | White . | |
| 1,689,419 | 10/1928 | Bronander . | |
| 2,169,807 | 8/1939 | Lyon | 417/488 |
| 3,302,578 | 2/1967 | Anderson | 427/488 |
| 3,471,079 | 10/1969 | Myers | 417/488 X |
| 3,476,056 | 11/1969 | Bright . | |
| 3,695,788 | 10/1972 | Loomens | 417/488 |
| 4,416,596 | 11/1983 | Lichtenstein . | |
| 4,730,992 | 3/1988 | Ogawa . | |

FOREIGN PATENT DOCUMENTS

| | | |
|---|---|---|
| 348911 | 4/1928 | Belgium . |
| 455860 | 6/1944 | Belgium . |
| 889258 | 12/1981 | Belgium . |
| 375407 | 6/1990 | European Pat. Off. . |
| 782769 | 7/1935 | France . |
| 2455687 | 11/1980 | France . |
| 2564525 | 11/1985 | France . |
| 3709899 | 10/1987 | Germany . |
| 3-5160 | 1/1991 | Japan . |
| 157692 | 1/1921 | United Kingdom . |

*Primary Examiner*—Richard E. Gluck
*Attorney, Agent, or Firm*—Oliff & Berridge

[57] ABSTRACT

A pump unit includes a suction pump and a driving mechanism for driving the suction pump. The suction pump has a pump body provided with a suction port and a discharge port which are axially spaced, and a first piston and a second piston slidably fitted in the pump body to form a suction chamber therebetween. In operation, the driving mechanism moves the first piston away from the second piston to expand the suction chamber so that a negative pressure prevails in the suction chamber and ink is suctioned through the suction port into the suction chamber; moves both the pistons at the same moving speed until the suction chamber is expanded to a predetermined extent, the suction port is closed by the second piston and the first piston opens the discharge port; moves the first piston in the reverse direction until the same comes into contact with the second piston to discharge the ink suctioned into the suction chamber through the discharge port; and moves both the pistons in the reverse direction to return the pistons to their initial position. The pump housing may be of a cylindrical shape or an annular shape. A suction pump in a modification may be provided with a plurality of pairs of pistons forming a plurality of suction chambers each provided with a suction port and a discharge port.

20 Claims, 14 Drawing Sheets

PUMP WITH INLET AND OUTLET SIMULTANEOUSLY EXPOSED TO PUMP CHAMBER AND METHOD OF OPERATING SAME

BACKGROUND OF THE INVENTION

1. Field of the Invention

The present invention relates to a pump and a pump unit comprising a pump and a driving mechanism and, more particularly, to a pump comprising a pump body and moving members slidably fitted in the pump body to form a chamber in the pump body, and a pump unit comprising such a pump and a driving mechanism.

2. Description of the Related Art

A suction pump of the type to which the present invention is related for suctioning ink is disclosed in European Laid-open Patent Publication Nos. 589541 and 375407. This suction pump is intended for use in an ink-jet recording apparatus to suction the ink remaining in the discharge ports of an ink-jet head and the ink remaining in an ink chamber. As shown in FIGS. 10 and 11, this suction pump comprises a cylindrical pump body 300, and a piston 302, i.e., a moving member, slidably fitted in the pump body 300 in a liquid-tight fashion and provided with a discharge port 310. The pump body 300 and the piston 302 define a suction chamber 304. When the suction pump operates for suction, a driving shaft 308 having a first head 312 and a second head 318 is moved to the right, as viewed in FIG. 10, by a driving mechanism, not shown. The discharge port 310 of the piston 302 is closed by the first head 312 of the driving shaft 308, and at the same time, the piston 302 is moved to the right with the first head 312. The volume of the suction chamber 304 increases and the pressure in the suction chamber 304 decreases as the piston 302 is moved to the right. Consequently, the ink is suctioned through a suction port 316 formed in the pump body 300 into the suction chamber 304 when the suction port 316 is opened. Then, as shown in FIG. 11, the driving shaft 308 is moved to the left. The second head 318 of the driving shaft 308 comes into contact with the end face 320 of the piston 302, and the first head 312 of the driving shaft 308 separates from the other end face 322 to open the discharge port 310 into the suction chamber 304. The piston 302 is moved to the left with the second head 318, and the volume of the suction chamber 304 decreases accordingly, so that the ink suctioned into the suction chamber 304 is discharged through the discharge port 310.

In this suction pump, the suction port 316 is opened and closed with the piston 302, and the discharge port 310 is opened and closed with the first head 312 formed integrally with the driving shaft 308. Thus, the suction port 316 and the discharge port 310 can be more reliably opened and closed with the piston 302 and the first head 312, respectively, than by a suction valve and a discharge valve, which are controlled by the ink. Since the suction port 316 and the discharge port 310 are opened and closed by the piston 302 that varies the volume of the suction chamber 304 and the first head 312, respectively, this suction pump does not need any valve driving mechanism for driving a suction valve and a discharge valve and has a simple construction.

However, this suction pump has a problem that arises unavoidably due to the use of the piston 302 for opening and closing the suction port 316 and the use of the first head 312 formed integrally with the driving shaft 308 for opening and closing the discharge port 310. For example, part of the ink suctioned into the suction chamber 304 flows backward unavoidably through the suction port 316. As mentioned above, when discharging the ink, the driving shaft 308 is moved to the left from the position shown in FIG. 10, and the first head 312 separates from the end face 322 of the piston 302 to open the discharge port 310. However, both the discharge port 310 and the suction port 316 are open at the moment when the discharge port 310 is opened, and the driving shaft 308 is moved to the left with the suction port 316 open to reduce the volume of the suction chamber 304. Consequently, part of the ink suctioned in the suction chamber 304 flows backward through the suction port 316 until the suction port 316 is closed by the piston 302. Furthermore, the volume of the suction chamber 304 of the suction pump at the completion of the discharge operation is not satisfactorily small, because the volume of the suction chamber 304 at the completion of the discharge operation cannot be reduced to a volume smaller than a volume corresponding to the distance d between the first head 312 and the end face 322 of the piston 302 in a state where the discharge port 310 is open (the valve lift), i.e., the product of the sectional area of the suction chamber 304 and the distance d. As mentioned above, the discharge port 310 is closed when the first head 312 of the driving shaft 308 comes into contact with the end face 322 of the piston 302; and the discharge port 310 is opened when the first head 312 is separated from the end face 322 of the piston 302, and the piston 302 is moved to the left with the second head 318 of the driving shaft 308 that pushes the piston 302 at the end face 320. Therefore, the length between the first head 312 and the second head 318 of the driving shaft 308 must be greater than the length of the piston 302, i.e., the distance between the end faces 320 and 322, by the valve lift amount d. Therefore, when the driving shaft 308 is moved to the left end position, a space of a width equal to the valve lift d remains between the end face 322 of the piston 302 and the first head 312, which is regarded as the bottom wall of the pump body 300, and a comparatively large quantity of the ink is left in the suction chamber. The ink left in the suction chamber will be called the residual ink.

Naturally, this suction pump can be used for supplying liquid other than the ink or gas, which will be referred to as "fluid," by pressure as well as for suctioning fluid, and the aforesaid problem arises therein when the suction pump is used for supplying a fluid by pressure.

SUMMARY OF THE INVENTION

The present invention has been made in view of the foregoing problem, and it is therefore an object of the present invention to provide a suction pump capable of reliably opening and closing its suction port and its discharge port, incorporating the advantages of the suction pump disclosed in Japanese Patent Laid-open No. Hei 3-5160 that any special valve driving mechanism is unnecessary using a simple construction, and to provide a suction pump capable of eliminating or reducing the effect of the disadvantages of this known suction pump that part of the fluid flows backward from the suction chamber through the suction port and that it is difficult to reduce the residual fluid.

Another object of the present invention is to provide a pump unit comprising, in combination, a suction pump meeting the aforesaid object of the present invention, and a driving mechanism suitable for driving the suction pump.

With the foregoing and other objects in view, a suction pump in a first aspect of the present invention comprises a cylindrical pump body provided with a suction port and a discharge port, and at least a pair of moving members slidably fitted in the pump body in a liquid-tight fashion opposite to each other to define a suction chamber therebetween together with the pump body and to open and close the suction port and the discharge port, respectively. The pump body may be of any hollow cylindrical shape, for example, a shape extending along a straight line or a shape extending along a curve, such as a circular arc, provided that the moving members can be slidably fitted therein. Although the most desirable sectional shape of the hollow of the pump body is a circular shape from the viewpoint of facility in machining and sealing, the sectional shape may be a semicircular shape, a polygonal shape or a composite of different shapes. The suction pump may be provided with two pairs of moving members, three pairs of moving members or more than three pairs of moving members. When the suction pump is provided with two or more pairs of moving members, two or more suction chambers are formed. When the suction pump is provided with two or more pairs of moving members, one moving member among the two pairs of moving members may be used as one member of each of the two pairs of moving members.

The backward flow of the fluid from the suction chamber through the suction port can be prevented when the volume of the suction chamber is not reduced while the suction port is open, and almost all the fluid suctioned into the suction chamber can be discharged by bringing the moving members into contact with each other at the end of the discharge operation.

A suction pump in accordance with a second aspect of the present invention has a straight, cylindrical pump body provided with a suction port and a discharge port spaced apart from each other. The suction pump may have an annular pump body and moving members slidably fitted in the annular pump body for circumferential movement. In this suction pump, a suction port and a discharge port are formed in the annular pump body at an angular interval. The construction of the suction pump is simplified when the suction pump has a straight, cylindrical pump body. The simple shapes of the pump body and the moving members facilitate machining work.

A pump unit in accordance with a third aspect of the present invention comprises the suction pump in the first or the second aspect of the present invention, and a driving mechanism capable of individually moving the moving members and the pump body for relative movement. The driving mechanism may be capable of individually moving the moving members relative to the pump body or may be capable of individually moving the pump body and the moving members, provided that the driving mechanism is capable of moving the pump body and the moving members individually for relative movement. The driving mechanism may be capable of linearly moving the straight pump body and the moving members along the axis of the straight pump body or may be capable of individually moving the annular pump body and the moving members about the center axis of the annular pump body for relative circular movement. A pump unit having the suction pump provided with two or more pairs of moving members may be provided with three or more driving mechanisms; however, two or more pairs of moving members can be moved by two driving mechanisms. When two driving mechanisms are used for moving two or more pairs of moving members, one of the two driving mechanisms is used for moving a plurality of moving members. When the suction pump comprises a straight pump body and a pair of moving members slidably fitted in the straight pump body, the pump unit may employ a driving mechanism comprising a driving source, such as an electric motor, and two motion converters for converting the rotative motion of the driving source into a linear motion or a driving mechanism comprising two driving sources and two motion converters. In the former driving mechanism, the two motion converters are driven by the single driving source. The driving mechanism may employ a linearly reciprocating driving source capable of linear reciprocation, such as a hydraulic cylinder actuator. When the suction pump comprises an annular pump body and at least a pair of moving members slidably fitted in the annular pump body for circular movement relative to the annular pump body, the driving mechanism may comprise a rotative driving source, such as an electric motor, for driving one of the pair of moving members for turning and a rotative driving source for driving the other moving member or may comprise a single rotative driving source and two motion converters for transmitting the rotative motion of the rotative driving source to the pair of moving members, respectively.

Since the movable members and the pump body can be individually moved for relative movement, the degree of freedom of combination of the timing of increasing the volume of the suction chamber, the timing of decreasing the volume of the suction chamber, the timing of opening and closing the suction port and the timing of opening and closing the discharge port can be enhanced.

A pump unit in accordance with a fourth aspect of the present invention comprises a suction pump comprising a pump body and at least one pair of moving members, and a driving mechanism capable of moving the pair of moving members relative to the pump body and comprising two cam followers capable of moving together with the pair of moving members, respectively, two cams in engagement with the two cam followers, respectively, and a driving source for rotating the two cams.

Since only one driving source is necessary for individually moving each pair of moving members relative to the pump body, the pump unit can be manufactured at a comparatively low manufacturing cost. The variable speeds of the moving members can be determined by the shape of the cams, and the relative movement of each pair of moving members can be accurately controlled by driving the two cams by the single driving source. Therefore, the driving source may be a simple constant-speed driving source, such as an ordinary electric motor, which contributes to the reduction of the manufacturing cost of the pump unit.

A pump unit in accordance with a fifth aspect of the present invention comprises the suction pump of the pump unit in the fourth aspect of the present invention and a driving mechanism for driving the pair of moving members relative to the pump body, comprising two driving sources for driving the pair of moving members, respectively.

Each pair of moving members can be controlled for relative movement by controlling the two driving sources, and hence, the mode of movement of the two moving members relative to each other can be readily changed. When cams are used for moving the moving members as in the fourth aspect of the present invention, the cams must be changed to change the mode of movement of the two moving members relative to each other; whereas the movement of the moving members relative to each other can be readily changed by changing the mode of electrical control of the driving sources when the movement of the moving members relative to each other is controlled through the control of the driving sources.

The suction pump in the first aspect of the present invention has at least one pair of moving members, and the suction chamber is formed between the pair of moving members. The volume of the suction chamber increases when the pair of moving members are moved away from each other and decreases when the pair of moving members are moved toward each other. The suction port and the discharge port formed in the pump body and opening into the suction chamber are opened and closed by the moving members, respectively; that is, the discharge port of the suction pump is different from the discharge port of the aforesaid known suction pump formed in the moving member and is opened and closed by the driving shaft. Therefore, the reduction of the volume of the suction chamber can be prevented when the suction port is open. Theoretically, the moving members can be moved toward each other so that the moving members hit against each other at a position near the discharge port. For example, in the suction pump provided with the pair of moving members, the backward flow of the fluid suctioned into the suction chamber can be prevented by holding the pair of moving members at a fixed distance from each other or moving the pair of moving members away from each other until the suction port is closed by one of the moving members so that the volume of the suction chamber may not be reduced. The volume of the suction chamber can be reduced to a very small volume or to substantially zero by moving the moving members so that the moving members hit against each other at the end of the discharging operation, so that almost all the fluid suctioned into the suction chamber can be discharged.

In the suction pump in the second aspect of the present invention, the suction port and the discharge port spaced apart from each other along the axis of the axially straight pump body are opened and closed as the moving members reciprocate linearly.

In the pump unit in the third aspect of the present invention, the driving mechanism drives the moving members and the pump body of the suction pump individually. Therefore, the pair of moving members can be moved toward and away from each other to vary the volume of the suction chamber. It is possible to close only the suction port, only the discharge port or both the suction port and the discharge port and to open both the suction port and the discharge port. The mode of driving the moving members and the pump body by the driving mechanism enhances the freedom of designing the combination of the timing of the start of increasing the volume of the suction chamber, the timing of the start of decreasing the volume of the suction chamber, the timing of the start of opening the suction port and the discharge port and the timing of closing the suction port and the discharge port according to the purpose.

In the pump unit provided with only a pair of moving members in the fourth aspect of the present invention, the two cam followers that move together with the pair of moving members are controlled by the two cams rotated by the single driving source. The two cams may be cam grooves formed in the end surface of a single rotating member.

In the pump unit provided with two or more pairs of moving members in the fourth aspect of the present invention, each pair of moving members is moved by the cooperative action of each cam and each cam follower, and all the cams are rotated by a single driving source. The variable moving speed of each moving member can be determined by the cam surface of the corresponding cam. Therefore, the driving source may be a constant-speed driving source, such as an ordinary electric motor.

In the pump unit in the fifth aspect of the present invention, the driving mechanism is provided with driving sources for individually driving the pair of moving members.

BRIEF DESCRIPTION OF THE DRAWINGS

The above and other objects, features and advantages of the present invention will become more apparent from the following description taken in connection with the accompanying drawings, in which.

DETAILED DESCRIPTION OF PREFERRED EMBODIMENTS

Figure 1:
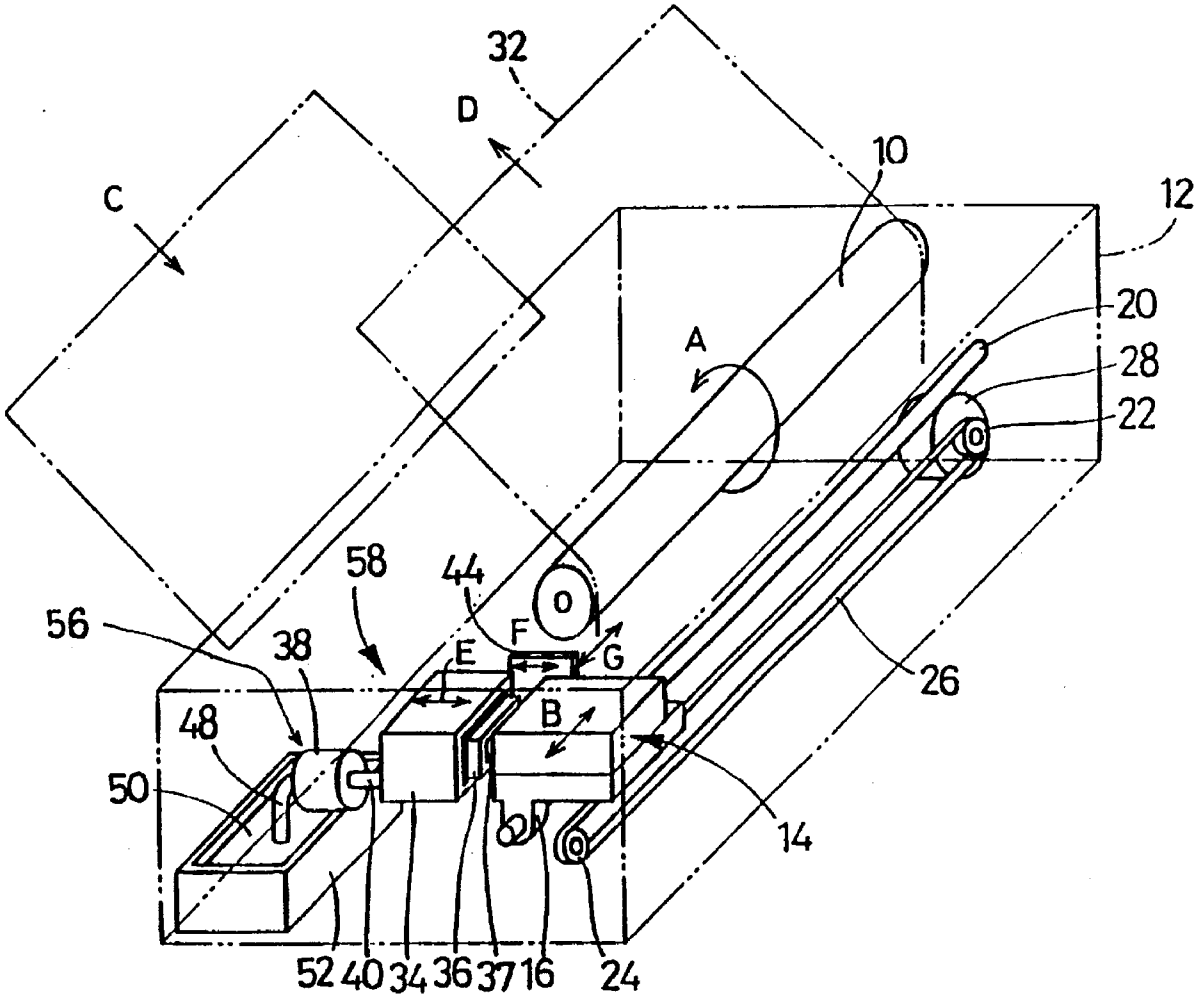
FIG. 1 is a schematic perspective view of an ink-jet recording apparatus provided with a pump unit in a first embodiment according to the present invention.
Figure 3:
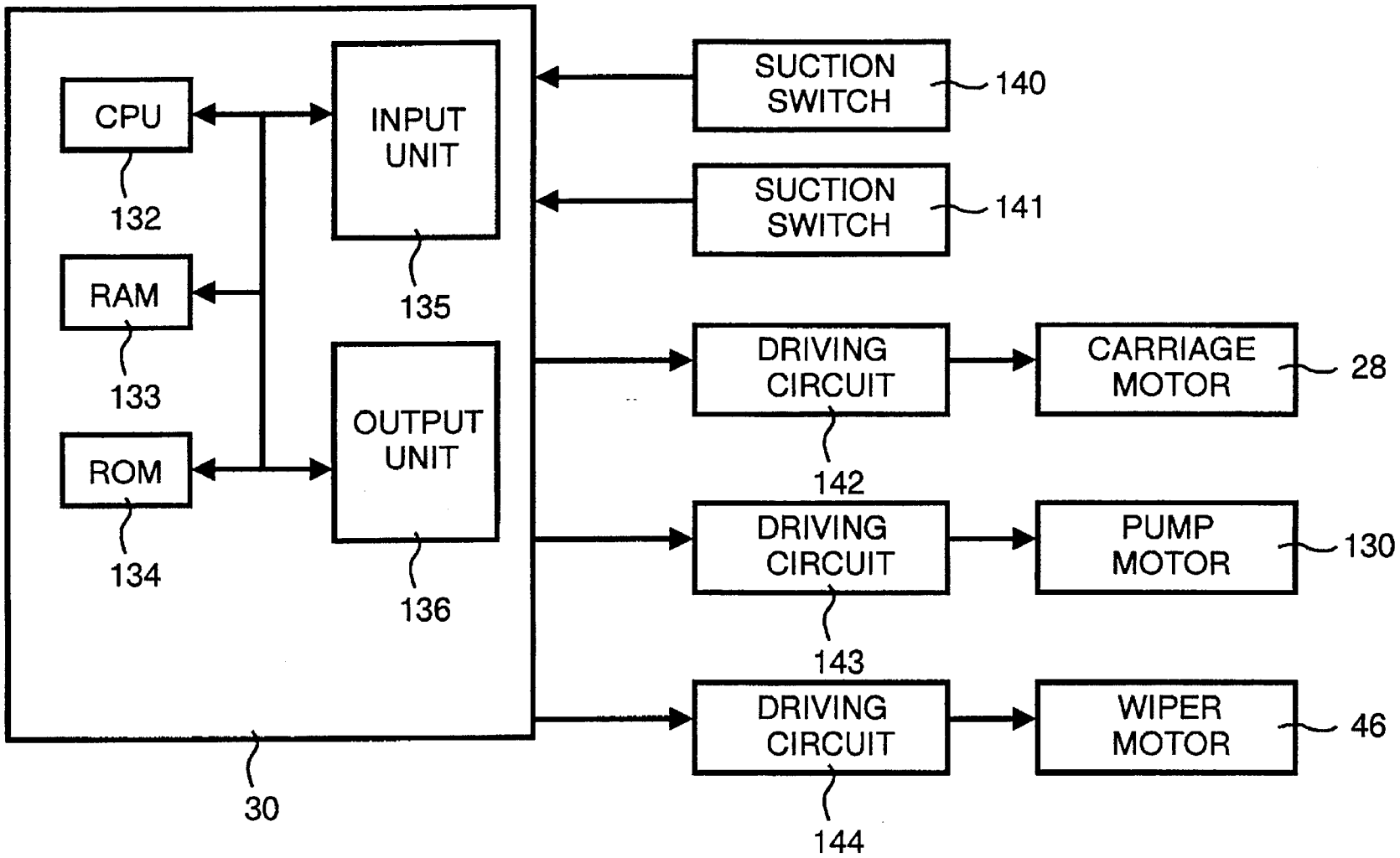
FIG. 3 is a block diagram of the controller of the ink-jet recording apparatus of FIG. 1.

Referring to FIG. 1, an ink-jet recording apparatus employing a pump unit 56 in a first embodiment according to the present invention comprises a cylindrical platen 10 supported for rotation in the direction of the arrow A on a frame 12, an ink-jet head 14 mounted on a carriage 16 slidably supported on a guide rod 20 disposed with its axis parallel to that of the platen to guide the carriage 16 for axial movement along the surface of the platen 10, a timing belt 26 extended between a driving pulley 22 and a driven pulley 24 and connected to the carriage 16, and a carriage motor 28 for rotating the driving pulley 22 to move the carriage 16 along the guide rod 16 in the directions of the arrows B. The ink-jet head 14 is reciprocated in a predetermined recording range during a recording operation and is held at a standby position outside the recording range after the completion of the recording operation. The ink-jet head 14 is provided with a plurality of ink passages and a plurality of nozzles corresponding to the plurality of ink passages. An ink supply device, not shown, mounted on the carriage 16 supplies ink into the ink passages. The ink passages are defined by vibratory plates. The vibratory plates are deformed selectively by a driving circuit, not shown, according to control signals generated on the basis of recording data and provided by a controller 30 as shown in FIG. 3 to increase the pressures in the corresponding ink passages to jet the ink through the corresponding nozzles. The ink is jetted against a recording sheet 32 fed to a space between the platen 10 and the ink-jet head 14 as the carriage 16 travels along the guide rod 20 to print an image line in one recording cycle. Upon the completion of the recording cycle for the line, the platen 10 is rotated to feed the recording sheet 32, and the recording cycle is performed for the next line. Thus, the recording cycle is repeated to form an image on the recording sheet 32. The recording sheet 32 is fed through a sheet inlet, not shown, formed in the rear part of the frame 12 in the direction of the arrow C, and is fed in the direction of the arrow D by the platen 10 through a sheet outlet, not shown.

A suction head 34 is disposed near one end of the platen 10 and opposite to the ink-jet head 14 in the standby position. The suction head 34 has a rubber cup 36 having a recess 37 of about 1.5 mm in width, 20 mm in length and 1 mm in depth in its central portion. The side walls of the rubber cap 36 defining the recess 37 come in close contact with the periphery of the array of the nozzles on the front surface of the ink-jet head 14 to cover the array of the nozzles hermetically. A suction passage, not shown, formed in the suction head 34 is connected to a through hole formed in the bottom wall of the rubber cap 36, and the suction passage is connected by a suction tube 40 to a suction pump 38. The suction head 34 is movable in the directions of the arrows E. Normally, the suction head 34 is held at a standby position. The ink-jet head 14 moves from a recording start/end position toward the standby position after the completion of one recording cycle for one line. Upon the arrival of the ink-jet head 14 at the standby position, a clutch, not shown, is engaged, and the carriage motor 28 drives the suction head 34 to advance the suction head 34 toward its working position. When the ink-jet head 14 is moved from the standby position toward the recording start/end position for the next recording cycle, the suction head 34 is retracted toward the standby position. Thus, the suction head 34 is held at the working position and the rubber cap 36 covers the nozzles while the ink-jet head 14 is at the standby position.

A wiper blade 44, i.e., a flexible plate, is held between the platen 10 and the suction head 34 to extend along and to be movable in the directions of the arrows F. The wiper blade 44 is easily bendable in the directions of the arrows G. Normally, the wiper blade 44 is held at its standby position. Upon the completion of one recording cycle, the wiper blade 44 is advanced to its working position by a wiper motor 46 (FIG. 3) and is bent by the ink-jet head 14 to be in close contact with the tips of the nozzles of the ink-jet head 14 to wipe the tips of the nozzles as the ink-jet head 14 moves from the recording start/end position toward its standby position. After a predetermined time, the wiper blade 44 is retracted to its standby position. At the start of the next recording cycle, the wiper blade 44 is advanced to its working position to wipe the tips of the nozzles as the ink-jet head 14 is moved from the standby position toward the recording start/end position. A discharge tube 48 has one end connected to the suction pump 38 and the other end connected to a waste ink tank 52 containing an absorber 50. The ink suctioned by the suction pump 38 is discharged through the discharge tube 48 into the waste ink tank 52, and the ink is absorbed by the absorber 50.

Figure 2:
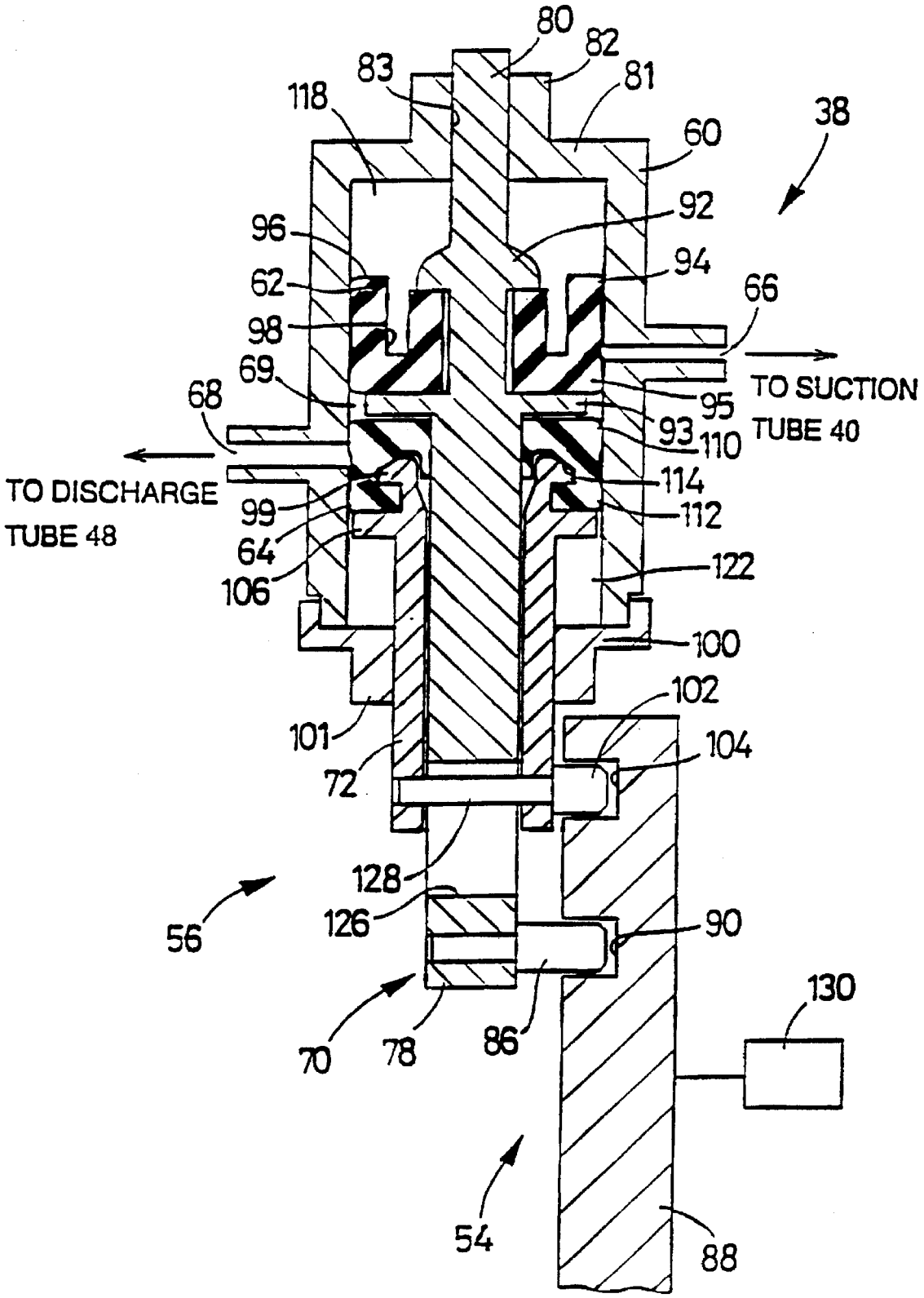
FIG. 2 is a sectional view of the pump unit of the ink-jet recording apparatus of FIG. 1.

Referring to FIG. 2, the pump unit 56 comprises the suction pump 38 and a driving mechanism 54. The pump unit 56, the suction head 34, a suction head moving mechanism for moving the suction head 34 between the standby position and the working position, and the suction tube 40 constitute a suction device 58. The suction pump 38 comprises a straight cylindrical pump body 60, a first piston 62 and a second piston 64, i.e., a pair of moving members, axially slidably fitted in the pump body 60, a first driving shaft 70 and a second driving shaft 72, which is a hollow shaft. The pump body 60 is fixed, and the pistons 62 and 64 are moved axially relative to the pump body 60.

A suction port 66 and a discharge port 68 are formed in the middle portion of the pump body 60 at axially spaced positions, respectively. The suction tube 40 is connected to the suction port 66, and the discharge tube 48 is connected to the discharge port 68. The pistons 62 and 64 are arranged axially in the pump body 60 to form a suction chamber 69 therebetween. The pistons 62 and 64 are put on the driving shafts 70 and 72, respectively. The driving shafts 70 and 72 are extended coaxially with the pump body 60. The first driving shaft 70 has one end portion 78 slidably fitted in the hollow second driving shaft 72 and the other end portion 80 having a diameter smaller than that of the end portion 78 and slidably fitted in a through hole 83 formed coaxially with the pump body 60 in a boss 82 formed on one end wall 81 of the pump body 60, so that the first driving shaft is axially movable within the pump body 60. A cam follower 86 is fixedly held on the end portion 78 of the first shaft 70 and is in engagement with a cam groove 90 of a cam 88. A first flange 92 and a second flange 93 are formed in the end portion 80 to hold the first piston 62 therebetween. The first piston has a substantially cylindrical shape and is formed of an elastic material, such as acrylonitrile-butadiene rubber (NBR). The respective outside diameters of the end portions 94 and 95 of the first piston 62 are greater than the inside diameter of the pump body 60. When the first piston 62 is fitted in the pump body 60, the end portions 94 and 95 are compressed so that the piston is in liquid-tight sliding contact with the inner circumference of the pump body 60. The inside diameter of the first piston 62 is greater than the diameter of the end portion 80, and the axial length of the first piston 62 is slightly greater than the interval between the flanges 92 and 93. An annular groove 98 is formed in the outer end surface 96 of the first piston 62, and the outer end surface of the flange 92 is rounded so that the first piston 62 can be easily put on the first driving shaft 70. When putting the first piston 62 on the first driving shaft 70, the inner circumference of the first piston 62 is expanded squeezing the annular groove 98, and the first piston 62 is guided over the rounded end surface of the flange 92 into the space between the flanges 92 and 93. The annular groove 98 and the inside diameter of the first piston 62 is greater than the end portion 80 facilitate the work for putting the first piston 62 on the first shaft 70. When set in place on the first driving shaft 70, the first piston 62 is compressed axially between the flanges 92 and 93, so that the first piston 62 is in elastic, liquid-tight contact with the flanges 92 and 93 and is unable to move axially relative to the first driving shaft 70.

The hollow second driving shaft 72 has a substantially tubular shape. The first driving shaft 70 is inserted in the second driving shaft in a loose fit with a clearance between the outer surface of the first shaft 70 and the inner surface of the second driving shaft 72. The second driving shaft 72 has a smaller first flange 99 at its inner end, and a larger second flange 106 near the first flange 99. The second driving shaft 72 is inserted through a through hole formed in a boss 101 formed on the other end 100 of the pump body 60 in the pump body 60 to be slidable relative to the pump body 60. A cam follower 102 is held fixedly on the outer end of the second driving shaft 72 and is in engagement with a cam groove 104 of the cam 88.

The second piston 64, similar to the first piston 64, has a substantially cylindrical shape and is formed of NBR. The respective outside diameters of the end portions 110 and 112 of the second piston 64 are greater than the inside diameter of the pump body 60. When the second piston 64 is fitted in the pump body 60, the end portions 110 and 112 are compressed so that the piston is in a liquid-tight sliding contact with the inner circumference of the pump body 60. The inside diameter of the second piston 64 is slightly smaller than the diameter of the end portion 78 of the first driving shaft 70. An annular groove 114 of a shape complementary to and slightly greater than that of the inner flange 99 is formed in the second piston 64, and the inner flange 99 is forced into the annular groove 114 to connect the second piston 64 to the second shaft 72. Thus, the second piston 64 is held between the inner flange 99 and the flange 106 and is unable to move axially on the second driving shaft Since the inside diameter of the second piston 64 in a free state is smaller than the diameter of the end portion 78, the second piston 64 is held in a liquid-tight fashion on the first driving shaft 70. Since the pistons 62 and are fitted in the pump body 60 and put on the driving shaft 70 in a liquid-tight fashion, the suction chamber 69 formed between the pistons 62 and 64 is sealed from an atmospheric chamber 118 formed between the first piston 62 and the end wall 81 and open to the atmosphere and from an atmospheric chamber 122 formed between the second piston and the end wall 100 and open to the atmosphere.

An axial slot 126 is formed in the end portion 78 of the first driving shaft to allow a guide shaft 128 fixedly holding the cam follower 102 on the second shaft 72 to move relative to the first driving shaft 70. When the cam 88 is rotated, the side surface of the cam groove 90 applies a frictional force that tends to push the cam follower 86 fixedly held on the first driving shaft in a direction perpendicular to the paper through the cam follower 86 to the first driving shaft 70 urging the driving shaft 70 in that direction. However, the first driving shaft 70 is restrained from movement in that direction by the guide shaft 128 fixed to the second driving shaft 72 inserted in the fixed pump body 60 and in engagement with the side surface of the slot 126, so that the suction device 58 is not affected adversely by the frictional force.

The driving mechanism 54 comprises, as principal components, the driving shafts 70 and 72, the cam followers 86 and 102, the cam 88 provided with the cam grooves 90 and 104, and a pump motor 130. When the cam 88 is rotated by the pump motor 130, the cam followers 86 and 102 move along the corresponding cam grooves 90 and 104 to move the driving shafts 70 and 72 axially, so that the pistons 62 and 64 are moved accordingly together with the driving shafts 70 and 72, respectively. The cam grooves 90 and 104 are designed to move the pistons 62 and 64 for predetermined movement, which will be described later. The cam 88 provided with the cam grooves 90 and 104 is a motion converter having functions to convert the rotating motion of the pump motor 130 into axial motions of the driving shafts 70 and 72 and to control the moving speeds of the pistons 62 and 64.

The pump motor 130 and the motors 28 and 46 are controlled by a driving circuit controlled by the controller 30 of the ink-jet recording apparatus. Referring to FIG. 3, the controller 30 for controlling the general operation of the ink-jet recording apparatus comprises, as principal components, a CPU 132, a RAM 133, a ROM 134, an input unit 135, an output unit 136. The RAM 133 stores recording data representing an image to be recorded, and the ROM stores programs for controlling the operation of the suction pump 38. Switches including suction switches 140 and 141 and a data input unit, not shown, are connected to the input unit 135. Driving circuits 142, 143 and 144 respectively for controlling the motors 28, 130 and 46, and a driving circuit, not shown, for controlling the vibrating plates of the ink-jet head 14 are connected to the output unit 136.

The ink-jet head 14 is held at the standby position and is covered with the rubber cup 36 before the ink-jet recording apparatus is started. Recording data is given to the ink-jet recording apparatus, the recording sheet 32 is fed to a recording area between the platen 10 and the ink-jet head 14, the wiper motor 46 is actuated to advance the wiper blade 44 to its working position, the carriage motor 28 is actuated to move the ink-jet head 14 from the standby position to the recording start/end position, and then the suction head 34 is retracted, and the tips of the nozzles of the ink-jet head 14 are wiped by the wiper blade 44 as the ink-jet head 14 is moved to the recording start/end position. The ink jetting operation of the ink-jet recording head 14 is controlled on the basis of the recording data while the ink-jet head 14 is reciprocated within the recording range to print an image represented by the recording data on the recording sheet 32.

The recording operation is terminated after all the recording data stored in the RAM 13 has been read out. Then, the wiper blade 44 is advanced to its working position, the ink-jet head 14 is moved from the recording start/end position toward the standby position, and the suction head 34 is advanced. The nozzles are covered with the rubber cup 36 after being wiped with the wiper blade 44. Since the nozzles are covered with the rubber cup 36, the nozzles will not dry while the ink-jet recording apparatus is not used and the ink-jet head 14 is inoperative. When the suction switch 140 is closed while the ink-jet head 14 is held at the standby position and the nozzles are covered with the rubber cup 36, a suction program is executed to control the pump motor 130. In this embodiment, the pump motor 130 is driven for one pumping cycle for suctioning the ink and discharging the suctioned ink. When the suction switch 141 is closed, the pumping cycle is repeated several times. The suction switch 140 or 141 is operated for the maintenance of the ink-jet head 14 when the ink-jet head 14 is unable to jet the ink satisfactorily. The suction switch 141 is operated when the normal ink jetting function of the ink-jet head 14 could not be restored by operating the suction switch 140 or when a large quantity of the ink needs to be suctioned after the ink cartridge of the ink supply unit has been changed. When the ink-jet head 14 malfunctions due to bubbles choking the nozzles or dust clogging the nozzles, the suction switch 140 is operated.

Figure 4A:
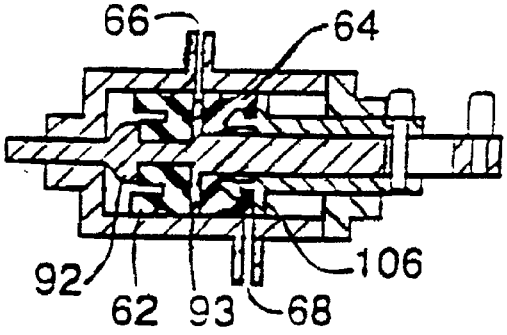
FIGS. 4(A), 4(B), 4(C), 4(D), 4(E) and 4(F) are schematic sectional views of the suction pump of the pump unit of FIG. 2 in different phases of operation.
Figure 4B:
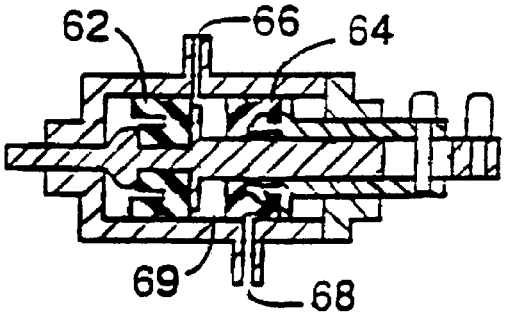

The operation of the pump unit 56 will be described hereinafter. When the pump unit 56 is inoperative, the suction pump 38 is in a state shown in FIG. 4(A), in which the first piston 62 is on the left side, as viewed in FIG. 4(A), of the suction port 66, the second piston 64 is in contact with the flange 93, and the discharge port 68 is closed by the second piston 64, in particular, by the end portion 112 of the second piston 64. When the cam 88 is rotated by the pump motor 130, the second piston 64 is shifted to the right still keeping the discharge port 68 closed and the first piston 62 unmoved, so that the volume of the suction chamber 69 increases as shown in FIG. 4(B). Consequently, a negative pressure prevails in the suction chamber 69, whereby the ink remaining in the nozzles is suctioned through the suction port 66 into the suction chamber 69. That is, the ink is suctioned after the air filling up the recess 37 of the rubber cup 36 has been suctioned. The ink is suctioned continuously as the volume of the suction chamber 69 increases due to the rightward movement of the second piston 64.

Figure 4C:
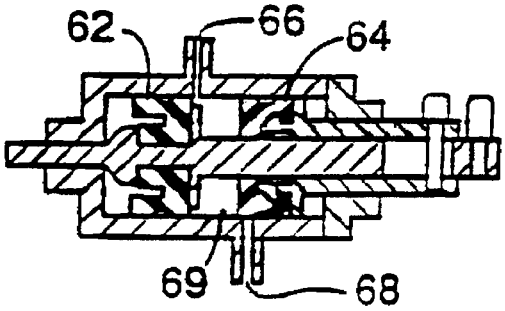

After the volume of the suction chamber 69 has increased to a predetermined volume as shown in FIG. 4(C), both the pistons 62 and 64 are shifted to the right at the same speed, so that the predetermined volume is maintained. The ink is suctioned further into the suction chamber 69 during the movement of both the pistons 62 and 64 until the pressure prevailing in the suction chamber 69 increases to the atmospheric pressure. If the pistons 62 and 64 are moved at a very low speed, the pressure in the suction chamber 69 can be always maintained at the atmospheric pressure by the air and the ink suctioned into the suction chamber 69. In this embodiment, the pistons 62 and 64 are moved at a comparatively high speed to keep a negative pressure in the suction chamber 69 even if the air and the ink flow into the suction chamber 69. Therefore, the ink can be suctioned through the suction port 66 into the suction chamber 69 even if the volume of the suction chamber 69 is constant.

Figure 4D:
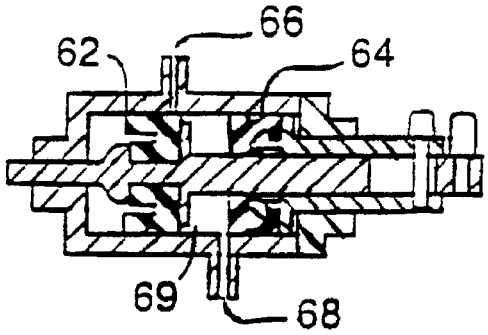

Then, the discharge port 68 is opened, and the suction port 66 is closed as shown in FIG. 4(D). The second piston 64 is stopped, and only the first piston 62 is moved farther to the right. Consequently, the volume of the suction chamber 69 decreases to discharge the ink suctioned into the suction chamber 69 through the discharge port 68. The discharged ink flows through the discharge tube 48 into the waste ink tank 52.

Thus, the volume of the suction chamber 69 is kept constant while the suction port 66 is open, and the volume is decreased after the suction port 66 has been closed, and the discharge port 68 has been opened to prevent the backward flow of the ink from the suction chamber 69 through the suction port 66. Since the pair of pistons 62 and 64 of the pump unit 56 can be individually moved, the volume of the suction chamber 69 formed between the pistons 62 and 64 can be regulated so that the ink may not flow backward.

Figure 4E:
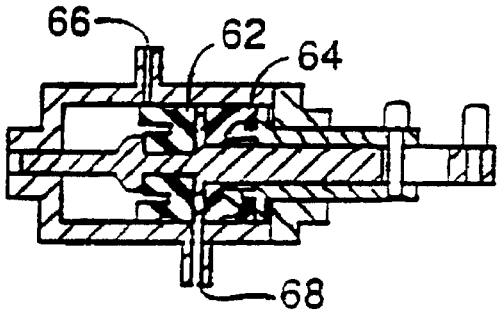
Figure 4F:
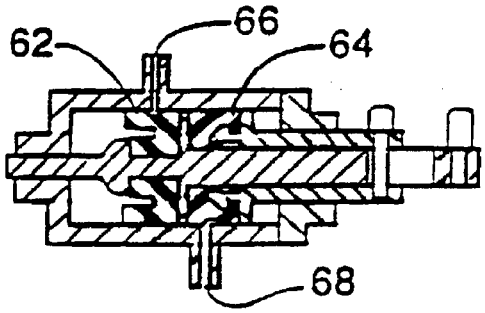

The first piston 62 is moved to the right until the flange 93 comes into contact with the second piston 64 held on the right edge of the discharge port 68 as shown in FIG. 4(E). In this state, the suction chamber 69 is only a very small annular space formed between the circumference of the flange 93 and the inner surface of the pump body 60. Thus, the volume of the suction chamber 69 can be reduced to a very small volume because the suction pump 38 is provided with the two pistons 62 and 64, and the two pistons 62 and 64 can be brought into contact with each other at a position near the discharge port 68. If the diameter of the flange 93 is substantially equal to the inside diameter of the pump body 60, the volume of the suction chamber 69 can be reduced substantially to zero at the end of the pumping cycle. Theoretically, the volume of the suction chamber 69 can be reduced to zero. Then, the pistons 62 and 64 are shifted to the left as shown in FIG. 4(F) to their initial positions shown in FIG. 4(A).

Thus, the suction pump 38 provided with the two pistons 62 and 64 is capable of efficiently removing bubbles and dust accumulated in the nozzles of the ink-jet head 14 together with the ink by suction to remove obstacles obstructing satisfactory ink jetting operation. Since the suction pump 38 prevents the backward flow of the ink suctioned through the suction port 66 into the suction chamber 69 without using any check valve, the number of parts and the cost of the pump unit 56 can be reduced. Since the volume of the suction chamber 69 is reduced to a very small volume at the end of the discharge operation, almost all the ink and the air suctioned into the suction chamber 69 can be discharged from the suction chamber 69. If the volume of the suction chamber 69 cannot be reduced satisfactorily and all the air suctioned into the suction chamber 69 cannot be discharged from the suction chamber 69, the residual air will be an obstacle to the smooth increase of the negative pressure in the suction chamber 69 in the next pumping cycle. The suction pump 38 in this embodiment effectively eliminates such troubles. Since the driving mechanism 54 has the cam 88 provided with two cam grooves 90 and 104 for controlling the two pistons 62 and 64, the suction pump 38 can be driven by the single motor 130.

The pistons 62 and 64 may be moved so that the volume of the suction chamber 69 increases during transition from the state shown in FIG. 4(C) to the state shown in FIG. 4(D) instead of moving the pistons 62 and 64 so that the volume of the suction chamber 69 remains constant. Control of the pistons 62 and 64 can be varied by changing the shape of either of the cam grooves 90 or 104 to further enhance the effect of the suction pump 38 in preventing the backward flow of the ink suctioned into the suction chamber 69.

The tips of the nozzles of the ink-jet head 14 may be wiped with the wiper blade 44 only either at the start or at the end of the recording operation instead of wiping both at the start and at the end of the recording operation. The wiper motor 46 for driving the wiper blade 44 may be manually started.

Although the housing 60 is fixed and the pistons 62 and 64 are moved in this embodiment, it is also possible to construct the pump unit 56 so that either the first piston 62 or the second piston 64 is fixed and the other piston and the housing 60 are moved or both the pistons 62 and 64 and the housing 60 are moved.

The pistons 62 and 64 may be formed of a rubber-like elastic material other than NBR. The pistons 62 and 64 and the driving shafts 70 and 72 may be formed in shapes other than those described above. The driving mechanism 54 may be substituted by a driving mechanism including two cams each provided with one cam groove, for driving the two pistons 62 and 64, respectively or a driving mechanism including two motors for driving the suction pump 38. The cam 88 serving as a motion converter may be substituted by a screw-nut mechanism.

A pump unit in a second embodiment according to the present invention will be described with reference to FIGS. 5(A) to 5(G). This pump unit is provided with a motion converter employing a screw-nut mechanism. The pump unit comprises a suction pump 158 comprising a pump body 60 a first piston 154 and a second piston 156, and a driving mechanism 162 comprising a driving shaft 160, a pump motor 161, and a motion converter employing a screw-nut mechanism, not shown. The pump motor and a carriage motor 28 are controlled by a driving circuit, not shown, controlled by a controller 163.

The two pistons 154 and 156 are fitted slidably in the pump body 60 provided with a suction port 66 and a discharge port 68. A suction chamber 164 is formed between the two pistons 154 and 156. The first piston 154 is fixed to a middle part of the driving shaft 160 to move axially together with the driving shaft 160. The second piston 156 is mounted on the driving shaft 160 in a liquid-tight fashion to be slidable relative to the driving shaft 160. Friction between the outer circumference of the second piston 156 and the inner circumference of the pump body 60 is greater than the friction between the inner circumference of the second piston 156 and the outer circumference of the driving shaft 160, so that the second piston 156 does not move when the driving shaft 160 moves. A stopper 166 is attached to the free end of the driving shaft 160, i.e., the end on a side opposite the side of the first piston 154 with respect to the second piston 156. The pistons 154 and 156, similar to the pistons 62 and 64 of the first embodiment, are substantially cylindrical members formed by molding NBR. The pistons 154 and 156 are fitted in the pump body 60 in a liquid-tight fashion to isolate the suction chamber 164 from an atmospheric chamber on the left side of the second piston 156 and an atmospheric chamber on the right side of the first piston 154. The rotative motion of the output shaft of the pump motor 161 of the driving mechanism 162 is converted into an axial motion by a screw-nut mechanism to move the driving shaft axially.

Figure 5A:
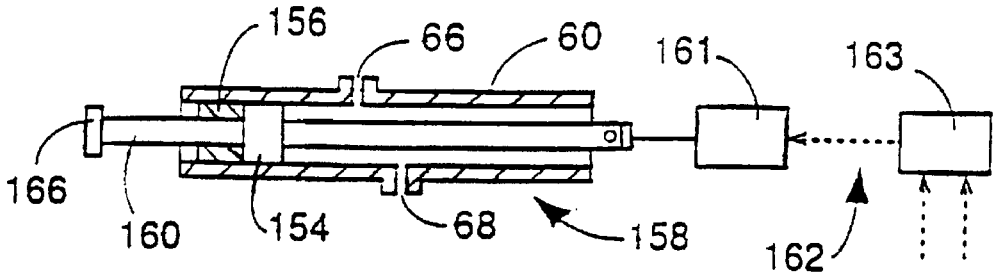
FIGS. 5(A), 5(B), 5(C), 5(D), 5(E), 5(F) and 5(G) are schematic sectional views illustrating the conception of construction of a second embodiment according to the invention.
Figure 5B:
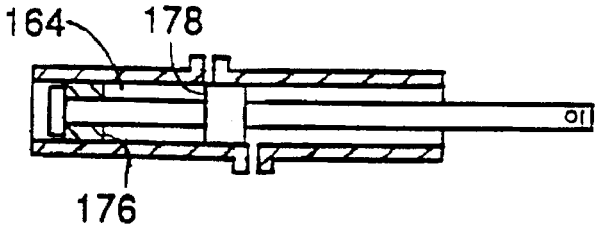
Figure 5C:
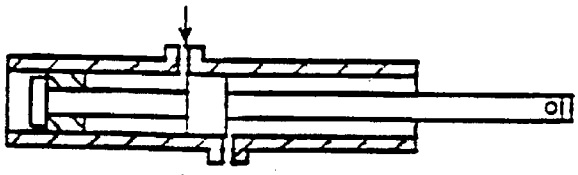
Figure 5D:
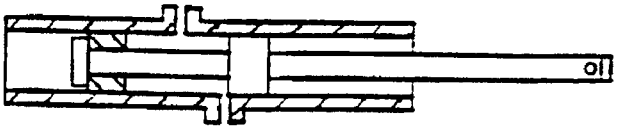
Figure 5E:
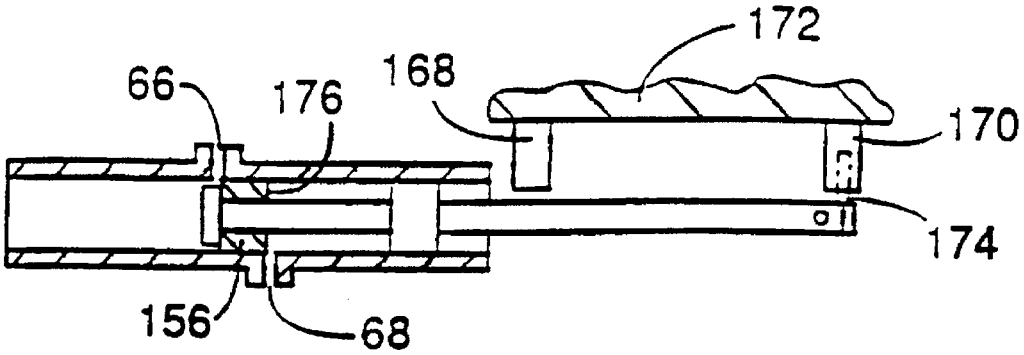

An input unit included in the controller 163 is connected to suction switches 140 and 141 and photoelectric sensors 168 and 170 (FIG. 5(E)). An output unit included in the controller 163 is connected to circuits including a driving circuit, not shown, for driving the pump motor 161. The photoelectric sensors 168 and 170 are position transducers capable of detecting the position of the driving shaft 160 and are fixedly mounted on the frame 172 of the pump unit. Each of the photoelectric sensors 168 and 170 is of a transmission type having a light-emitting element and a light-receiving element. A dog 174 attached to the driving shaft 160 is detected when the light emitted by the light-emitting element is intercepted by the dog 174 and is unable to reach the light-receiving element. When the dog 174 is detected by the photoelectric sensor 168, the driving shaft 160 is at its leftmost position, and the pistons 154 and 156 are at their leftmost positions, respectively. When the dog 174 is detected by the photoelectric sensor 170, the driving shaft 160 is at its rightmost position, and the right end surface 176 of the second piston 156 is at a position corresponding to the left edge of the discharge port 68.

When the suction switch 140 is operated, the pump motor 161 drives the screw-nut mechanism to shift the driving shaft 160 rightward. Upon the detection of the dog 174 by the photoelectric sensor 170, the pump motor 161 is reversed to drive the screw-nut mechanism to shift the driving shaft 160 leftward. Upon the detection of the dog 174 by the photoelectric sensor 168, the pump motor 161 is stopped to complete one axial stroke of the driving shaft 160 for one pumping cycle.

The pumping cycle will now be described. Normally, the pistons 154 and 156 are positioned at their initial positions, respectively, near the left end of the pump body 60 as shown in FIG. 5(A). The pump motor 161 is started to shift the driving shaft 160 rightward together with the first piston 154, leaving the second piston 156 at is initial position. Consequently, the suction chamber 164 formed between the pistons 154 and 156 expands, and a negative pressure prevails in the suction chamber 164. After the stopper 166 has come into contact with the second piston 156 as shown in FIG. 5(B), the driving shaft 160 is shifted together with the pistons 154 and 156, so that the volume of the suction chamber 164 is kept constant. Upon the arrival of the left end face 178 of the first piston 154 at a position corresponding to the right edge of the suction port 66, the suction port 66 is opened as shown in FIG. 5(C), so that the ink remaining in the nozzles is suctioned through the suction port 66 into the suction chamber 164. Since the suction port 66 is opened into the suction chamber 164 in which a negative pressure prevails, the ink is suctioned rapidly into the suction chamber 164. Therefore, the ink flows at a velocity higher than that of the ink suctioned by the suction pump 38 in the first embodiment, and bubbles and dust accumulated in the nozzles can be satisfactorily removed, and hence, a less quantity of the ink is wasted. Although the pistons 154 and 156 are moved farther rightward keeping the volume of the suction chamber 164 constant, the ink can be suctioned until the pressure in the suction chamber 164 increases to the atmospheric pressure.

Figure 5F:
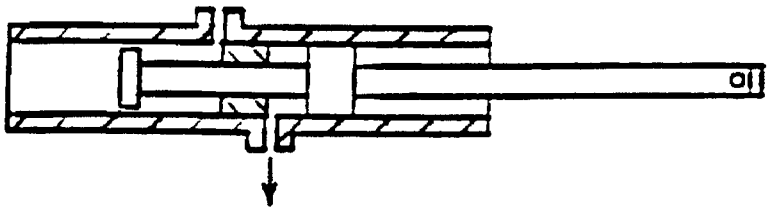
Figure 5G:
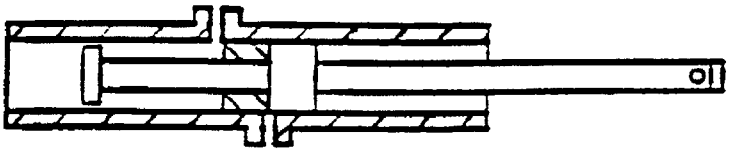

When the pistons 154 and 156 are moved to positions shown in FIG. 5(D), the discharge port 68 is opened into the suction chamber 164. Since the pressure in the suction chamber 164 is substantially equal to the atmospheric pressure in the state shown in FIG. 5(D), the ink is hardly able to flow through the discharge port 68 out of the suction chamber 164. After the suction port 66 has been closed and the right end face 176 of the second piston 156 has reached a position corresponding to the left edge of the discharge port 68 as shown in FIG. 5(E), the driving shaft 160 is reversed. As the driving shaft 160 is moved leftward, the first piston 154 moves leftward while the second piston 156 remains unmoved as shown in FIG. 5(F), so that the volume of the suction chamber 164 decreases and the ink suctioned into the suction chamber 164 is discharged through the discharge port 68. Then, the left end face 178 of the first piston 154 comes into contact with the right end face 176 of the second piston 156 as shown in FIG. 5(G), and the volume of the suction chamber 164 is reduced to substantially zero, so that almost all the ink suctioned into the suction chamber 164 is discharged. Thereafter, the pistons 154 and 156 are moved farther leftward as the driving shaft 160 is moved farther leftward, and finally, the pistons 154 and 156 reach their initial positions, respectively, in the state shown in FIG. 5(A).

Thus, the suction pump 158 in the second embodiment has the single driving shaft 160 for moving the two pistons 154 and 156 relative to each other. Therefore, only one set of the pump motor 161, i.e., a driving source, and the screw-nut mechanism, i.e., a motion converter is provided. Since the driving shaft 160 is provided with the stopper 166, the two pistons 154 and 156 can be moved with the volume of the suction chamber 164 kept accurately at a fixed volume. The suction port 66 may be opened before the volume of the suction chamber 164 is increased to a maximum to apply a large suction to the ink instead of keeping the volume of the suction chamber 164 constant by bringing the stopper 166 into contact with the second piston 156 before the suction port 66 is opened into the suction chamber 164.

In the states shown in FIGS. 5(A), 5(E) and 5(G), the suction port 66 may be closed by the outer circumference of the second piston 156.

When the pump motor 161 is a rotative driving device, the angular displacement of the output of which can be controlled, such as a servomotor or a stepping motor, the operation of the pump motor 161 may be controlled on the basis of the angular displacement of the output thereof instead of on the basis of the output signals of the photoelectric sensors 168 and 170, and the photoelectric sensors may be omitted. The driving shaft 160 can be driven for the predetermined stroke by rotating the output shaft of the servomotor or the line by a predetermined number of turns in one direction and by a predetermined number of turns in the opposite direction.

The motion converter need not be limited to the screw-nut mechanism. A rack-pinion mechanism or a crank mechanism may be employed as the motion converter. Since a crank mechanism is capable of converting a rotating motion into a linear reciprocating motion and is capable of determining the range of movement of the driving shaft 160, the pump motor 161 need not be reversed, and the angular displacement of the output shaft of the pump motor 161 need not be very accurately controlled. Limit switches or proximity switches may be used instead of the photoelectric sensors 168 and 170 for detecting the position of the driving shaft 160. The driving shaft 160 may also be manually moved.

Referring to FIGS. 6(A) to 6(G) showing a pump unit in a third embodiment according to the present invention, the pump unit comprises a suction pump 204 including a pump body 60, a first piston 200 and a second piston 202, and a driving mechanism comprising a first cam 206 provided with a cam groove, not shown, and a first cam follower 207, a second cam 208 provided with a cam groove, not shown, and a second cam follower 209, a pump motor 210, i.e., an electric motor, for rotating the cams 206 and 208, a first driving shaft 212 and a second driving shaft 214. The pistons 200 and 202 are slidably fitted in the pump body 60 in a liquid-tight fashion to form a suction chamber 218 therebetween. The driving shafts 212 and 214 are extended in opposite directions from the pistons 200 and 202, respectively. Cam followers are held fixedly on the free ends of the driving shafts 212 and 214 and are in engagement with the cam grooves of the cams 206 and 208, respectively. In this driving mechanism 216, the pump motor 210 drives both the cams 206 and 208 for rotation to shift driving shafts 212 and 214 axially at predetermined variable speeds, respectively. Thus, the driving mechanism 216 has two driving systems that are driven by the single pump motor 210.

Figure 6A:
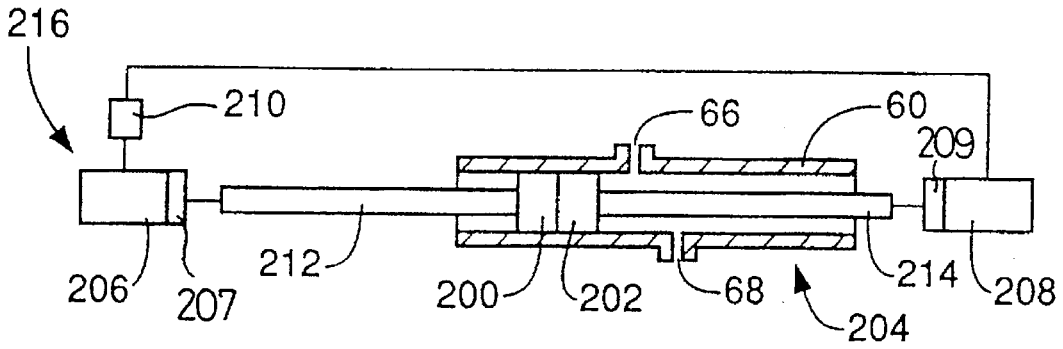
FIGS. 6(A), 6(B), 6(C), 6(D), 6(E), 6(F) and 6(G) are schematic sectional views illustrating the conception of construction of a pump unit in a third embodiment according to the present invention.
Figure 6B:
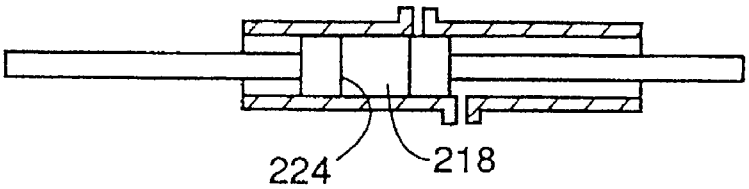
Figure 6C:
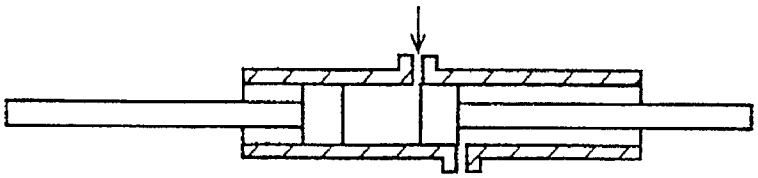

The operation of the pump unit will be described with reference to FIGS. 6(A) to 6(G). In the normal state shown in FIG. 6(A), the pistons 200 and 202 are positioned near the left end of the pump body 60. The pump motor 210 is actuated to rotate the cams 206 and 208, so that only the second piston 202 is shifted rightward, and the first piston 200 remains stationary. Consequently, the second piston 202 is separated from the first piston 200, and the volume of the suction chamber 218 formed between the pistons 200 and 202 increases as shown in FIG. 6(B). When the second piston 202 is shifted to a position shown in FIG. 6(C), the suction port 66 is opened into the suction chamber 218 in which a negative pressure prevails, and the ink remaining in the nozzles is suctioned through the suction port 66 into the suction chamber 218. The suction port 66 is opened before the volume of the suction chamber 218 reaches a maximum.

Figure 6D:
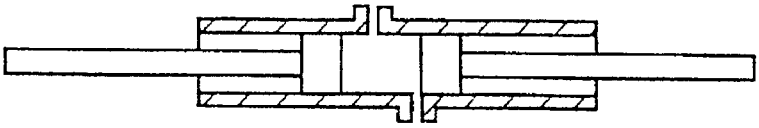
Figure 6E:
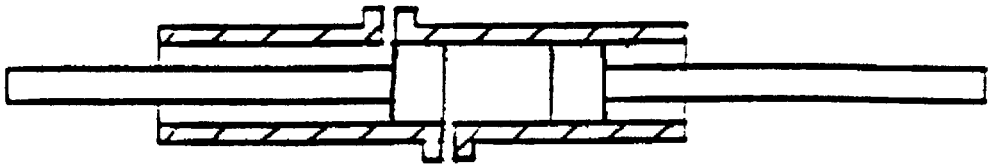
Figure 6F:
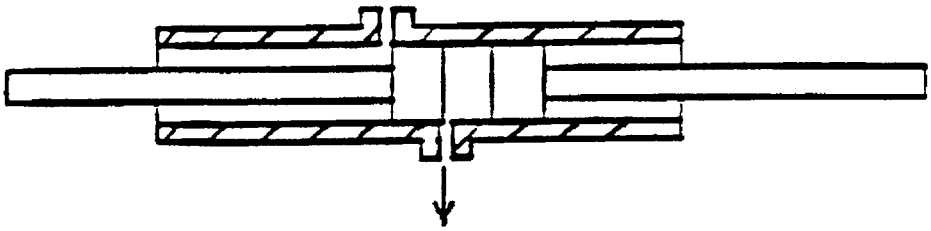
Figure 6G:
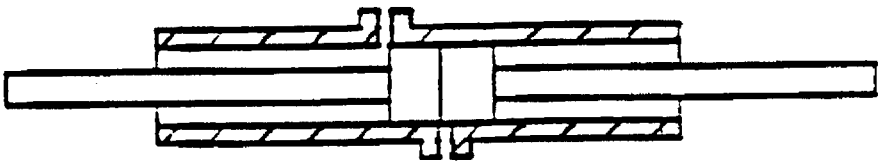

Thereafter, the pistons 200 and 202 are moved rightward at the same speed to keep the volume of the suction chamber 218 constant as shown in FIGS. 6(D) and 6(E). After the suction port 66 has been closed by the first piston 202 and the discharge port 68 has been opened into the suction chamber 218, the first piston 200 is stopped and the second piston 202 is shifted leftward. Then, the volume of the suction chamber 218 decreases, and the ink suctioned into the suction chamber 218 is discharged through the discharge port 68 as shown in FIG. 6(F). After the second piston 202 has come into contact with the first piston 202 as shown in FIG. 6(G), both the pistons 200 and 202 are shifted leftward at the same speed to their initial positions shown in FIG. 6(A).

Thus, the cams 206 and 208 can be synchronously driven by the single pump motor 210, whereby the pistons 200 and 202 can be accurately moved relative to each other at predetermined variable speeds, respectively. The cams 206 and 208 may be driven by two pump motors, respectively, and the operations of the two pump motors may be controlled electrically. When the two pump motors are used, the variable speeds of the pistons 200 and 202 can be easily changed to some extent. Screw-nut mechanisms or the like may be employed instead of the cams 206 and 208 as motion converters, and the screw-nut mechanisms may be driven by separate electric motors to drive the driving shafts 212 and 214, respectively. Since the movement of the pistons 200 and 202 relative to each other can be controlled only through the control of the electric motors, the modes of movement of the pistons 200 and 202 relative to each other can be more easily changed by changing the mode of electric control of the electric motors than by changing the cams 206 and 208.

The moving speeds of the pistons of the suction pump of the pump unit in the first embodiment may be the same as those of the pistons of the suction pump of the pump unit in the second or the third embodiment or the moving speeds of the pistons of the suction pumps of the pump units in the second and the third embodiment may be the same as those of the pistons of the suction pump of the pump unit in the first embodiment.

The pump unit in each of the foregoing embodiments may be provided with a suction pump having two or more pairs of pistons. In a suction pump provided with a plurality of pairs of pistons, the pistons may be axially arranged or one of the pair of pistons may be used also as one of another pair of pistons. Such a suction pump is able to suction the ink through a plurality of suction heads and is suitable for use on an ink-jet recording apparatus provided with a plurality of ink-jet heads for full-color recording.

A suction pump in a fourth embodiment according to the present invention will now be described. As shown in FIGS. 7(A) to 7(D), a pump body 230 is provided with two suction ports 232 and 234 and two discharge ports 236 and 238. Three pistons 240, 241 and 242 are slidably fitted in the housing 230 in a liquid-tight fashion. The pistons 240 and 241 operate as a first piston pair 244, and the pistons 241 and 242 operate as a second piston pair 245. A first suction chamber 246 is formed between the pistons 240 and 241, and a second suction chamber 248 is formed between the pistons 241 and 242. The piston 241 serves as one of the pistons of each of the piston pairs 244 and 245. The pistons 240 and 242 are driven by a first driving mechanism, and the piston 241 is driven by a second driving mechanism. A hollow shaft extends from the piston 242 in a direction away from the piston 241, an inner shaft extends through the hollow shaft, penetrating the piston 242 in a liquid-tight fashion and is fixed to the piston 241, and a plurality of connecting rods penetrate the piston 241 at positions on a circle of a radius with its center on the axis of the piston 241 in a liquid-tight fashion and interconnect the pistons 240 and 242.

Operation of the suction pump will now be described. In a state shown in FIG. 7(A) the ink suctioned in the preceding pumping cycle is stored in the second suction chamber 248, the discharge port 238 is open, and the discharge port 236 and the suction ports 232 and 234 are closed. First, only the piston 241 is moved rightward to reduce the volume of the second suction chamber 248, so that the ink is discharged through the discharge port 238 from the second suction chamber 248 and so that the suction port 232 is opened, the volume of the first suction chamber 246 increases, and the ink is suctioned through the suction port 232 into the first suction chamber 246. The piston 241 comes into contact with the piston 242 at a position near the discharge port 238 as shown in FIG. 7(B) to complete discharging the ink stored in the second suction chamber 248. Then, the pistons 240 and 242 are moved rightward together with the piston 241. The pistons 240, 241 and 242 are stopped when the discharge port 236 is opened as shown in FIG. 7(C). In this state, the suction port 232 is closed by the piston 240. Since the volume of the first suction chamber 246 is kept constant while the pistons 240, 241 and 242 are moved rightward, the ink does not flow backward from the suction port 232. Then, the pistons 240 and 242 are moved farther rightward, so that the volume of the first suction chamber 246 is reduced, and the ink is discharged through the discharge port 236 accordingly. The suction port 234 is opened, and the ink suctioned from the nozzles flows through the suction port 234 into the second suction chamber 248. Then, as shown in FIG. 7(D), the pistons 240, 241 and 242 are moved leftward at the same speed after the piston 240 has come into contact with the piston 241 to return the pistons 240, 241 and 242 to their initial positions shown in FIG. 7(A). The ink suctioned into the first suction chamber 246 is discharged while the ink suctioned into the second suction chamber 248 remains therein.

Thus, while the first piston pair 244 operates to suction the ink, the second piston pair 245 operates to discharge the ink. Accordingly, the strokes of the pistons 240, 241 and 242 may be shorter than those of the pistons of a suction pump provided with only one pair of pistons capable of suctioning the same quantity of the ink in one pumping cycle. A driving mechanism for driving the suction pump provided with the pistons 240, 241 and 242 can be formed in a comparatively small construction, and the time necessary for reciprocating the pistons 240, 241 and 242 several times to suction the ink is comparatively short. The length of the pump body 230 of this suction pump is smaller than that of the pump body of a suction pump having the same displacement and provided with two pairs of pistons arranged in series.

Figure 7A:
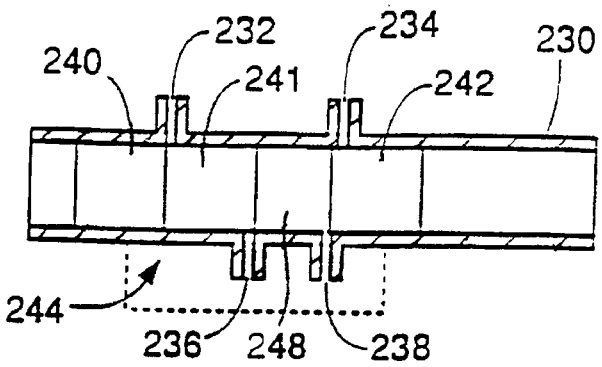
FIGS. 7(A), 7(B), 7(C) and 7(D) are schematic sectional views illustrating the conception of construction and the operation of a pump unit in a fourth embodiment according to the present invention.
Figure 7B:
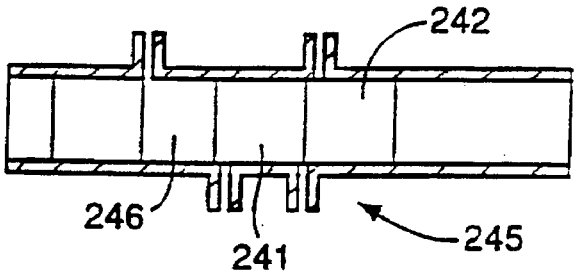
Figure 7C:
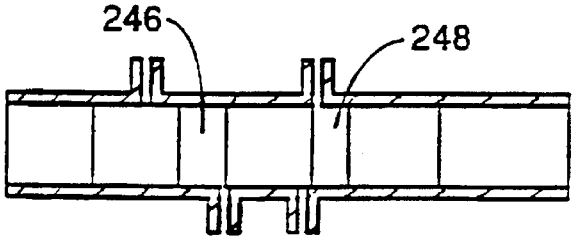
Figure 7D:
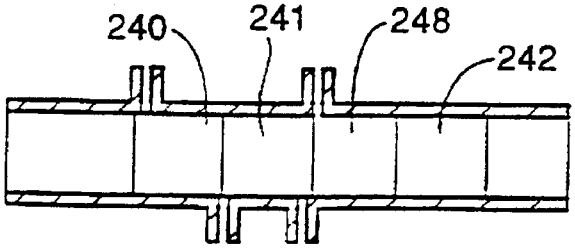

In the state shown in FIG. 7(A), the discharge port 238 may be closed by the piston 242. If the discharge port 238 is closed, the initial position of the piston 240 is shifted slightly to the left and all the pistons 240, 241 and 242 are shifted slightly to the right at the start of the pumping cycle.

Figure 8:
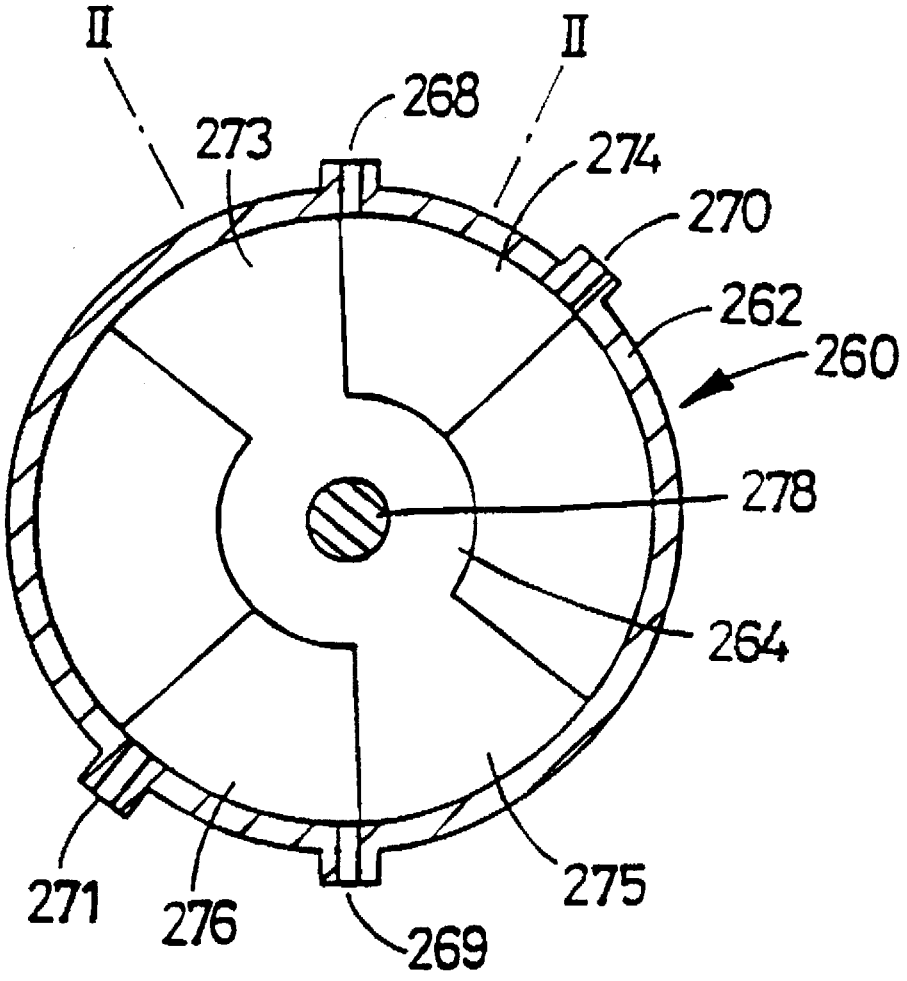
FIG. 8 is a sectional view of a pump unit in a fifth embodiment according to the present invention, taken on line I—I in FIG. 9.
Figure 9:
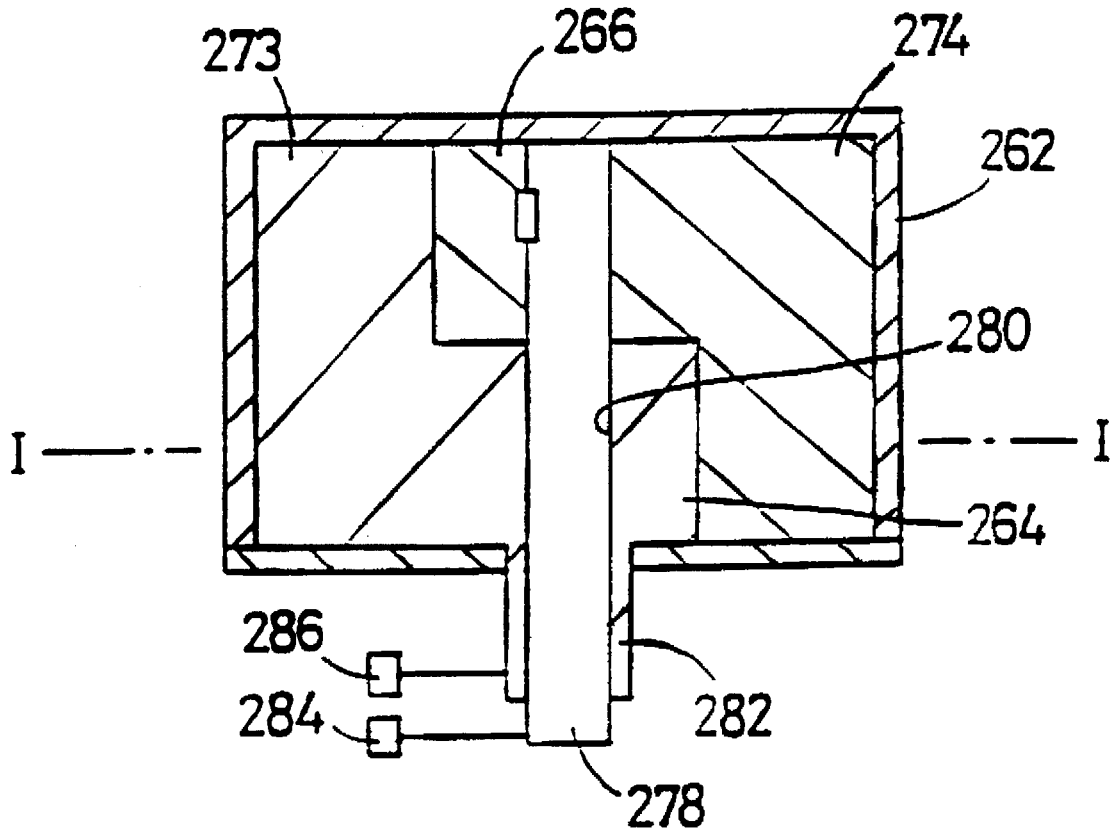
FIG. 9 is a schematic sectional view taken on line II—II in FIG. 8.
Figure 10:
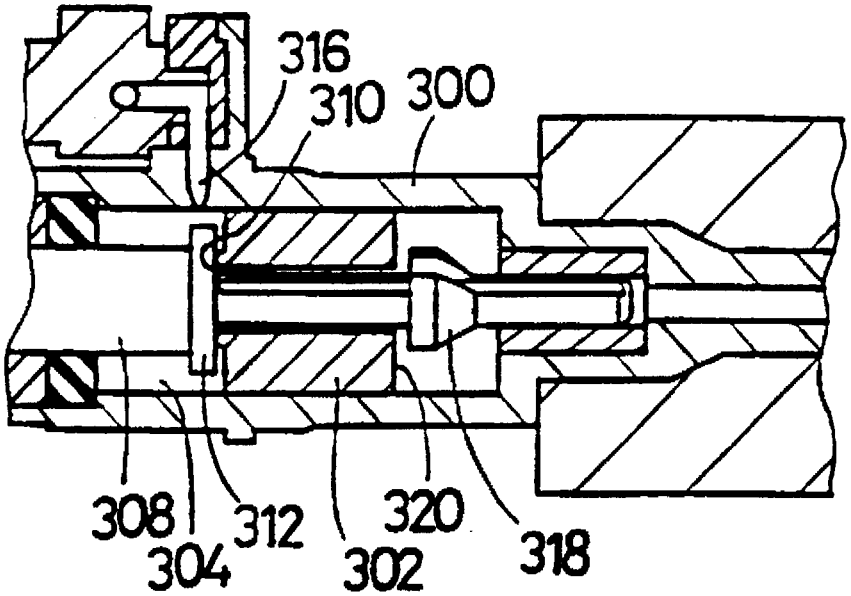
Fig.10 PRIOR ART
FIG. 10 is a fragmentary schematic sectional view of a conventional suction pump for suctioning the ink in one phase of operation.
Figure 11:
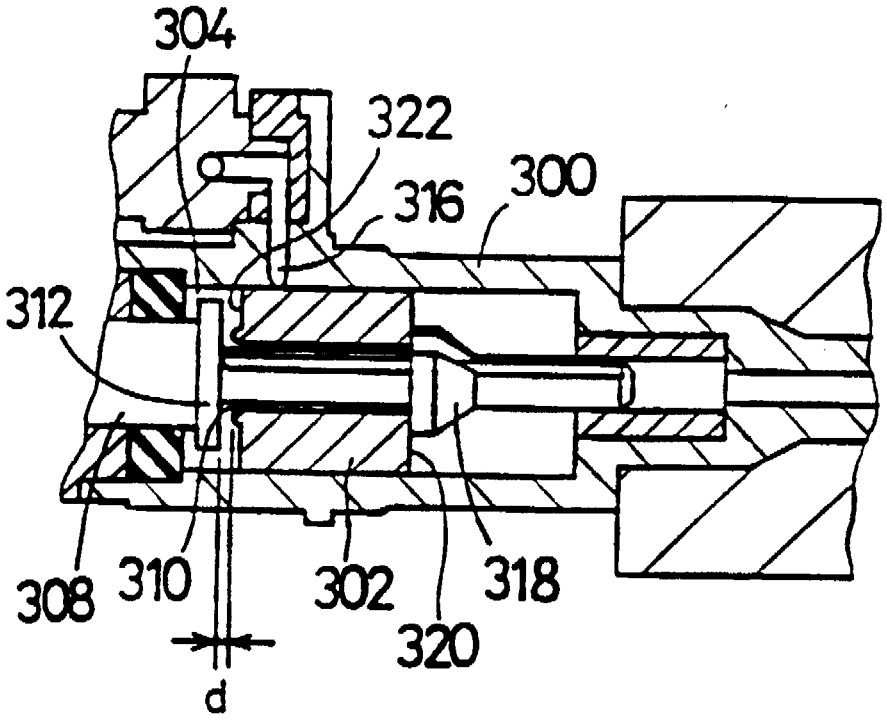
Fig.11 PRIOR ART
FIG. 11 is a fragmentary schematic sectional view of the suction pump of FIG. 10 in another phase of operation.

A pump unit in a fifth embodiment according to the present invention will be described with reference to FIGS. 8 and 9. This pump unit has a suction pump having an annular pump body 260 having an outer shell 262 and inner shells 264 and 266. Two suction ports 268 and 269 and two discharge ports 270 and 271 are formed in the pump body 262 at angular intervals. Four pistons 273, 274, 275 and 276 are slidably fitted in the outer shell 262 in a liquid-tight fashion. The pistons 273 and 275 are fixed to the outer circumference of the inner shell 264 at diametrically opposite positions, respectively, and the pistons 274 and 276 are fixed to the outer circumference of the inner shell 266 at positions diametrically opposite to each other. The inner shell 266 is fixedly mounted on an inner shaft 278. One end of the inner shaft 278 is extended through a through hole 280 formed in the central part of the inner shell 264 and projects outside from the pump body 260. A portion of the inner shell 264 surrounding the through hole 280 projects outside from the pump body 260 in a hollow shaft 282.

A first pump motor 284 is connected to the inner shaft 278 to turn the pistons 274 and 276 and the inner shell 266. A second pump motor 286 is connected to the hollow shaft 282 to turn the pistons 273 and 275 and the inner shell 264. Therefore, the pair of pistons 273 and 274 and the pair of pistons 275 and 276 are turned individually relative to the pump body 260. The inner shells 264 and 266 serve as both the components of the pump body 260 and driving members. The operation of this pump unit is the same as those of the foregoing embodiments, and hence, the description thereof will be omitted In this embodiment, each pair of pistons performs suction and discharge simultaneously.

Although the diameter of this suction pump is greater than that of a suction pump having a cylindrical pump body and the same displacement, the length of the former is smaller than that of the latter. Therefore, in some cases, the suction pump in this embodiment has an advantage over a suction pump having a cylindrical pump body and the same displacement depending on the shape of a space available for installing the suction pump. The configuration of the suction pump in this embodiment is advantageous to a suction pump having a plurality of suction chambers, particularly, three or more suction chambers. An incomplete cylindrical pump body may be used instead of a cylindrical pump body. When an incomplete cylindrical pump body is used, driving members can be inserted in the pump body through an opening in the incomplete cylindrical pump body to drive pistons fitted in the pump body.

Although the pump units in accordance with the present invention have been described as applied to an ink-jet recording apparatus, for suctioning the ink from the nozzles of the ink-jet head, the pump units may be applied to other purposes.

The invention has been described in its preferred forms with a certain degree of particularity. Obviously many changes and variations are possible therein. It is therefore to be understood that the present invention may be practiced otherwise than as specifically described herein without departing from the scope and spirit thereof.

What is claimed is:

1. A pump comprising:

a cylindrical pump body;

a first moving member and a second moving member slidably fitted in the pump body in a liquid-tight fashion and in an axially opposite arrangement, the first moving member and the second moving member forming a pump chamber therebetween;

a suction port and a discharge port formed in the pump body, said suction port and said discharge port being controllably opened and closed by the first moving member and the second moving member;

a first cam member located proximate the first moving member; and a second cam member located proximate the second moving member such that the first cam member and second cam member cause the first moving member and the second moving member to move at substantially equal speeds when the pump chamber is open to both the suction port and the discharge port.

2. The pump according to claim 1, wherein the pump body has the shape of a straight cylinder, and wherein the suction port and the discharge port are axially spaced.

3. The pump according to claim 1, wherein said first moving member comprises a first piston coupled to a first driving shaft for reciprocating movement in said cylindrical pump body, and said second moving member comprises a second piston coupled to a second driving shaft for reciprocating movement in said cylindrical pump body, said first piston and said first driving shaft being movable relative to said second piston and said second driving shaft.

4. The pump according to claim 3, wherein said first driving shaft and said second driving shaft are coaxial.

5. The pump according to claim 4, wherein said first driving shaft and said second driving shaft are concentric.

6. The pump according to claim 1, wherein the shapes of the first cam member and the second cam member cause the first moving member and the second moving member to develop and maintain a negative pressure in the pump chamber immediately before the pump chamber is opened to the suction port, said negative pressure being suitable to draw fluid from the suction port into the pump chamber.

7. The pump according to claim 6, wherein the negative pressure is a peak negative pressure.

8. A pump unit comprising:

a pump including:

a cylindrical pump body, a first moving member and a second moving member slidably fitted in the pump body in a liquid-tight fashion and in an axially opposite arrangement, the first moving member and the second moving member forming a pump chamber therebetween, and a suction port and a discharge port formed in the pump body, said suction port and said discharge port being controllably opened and closed by the first moving member and the second moving member; and a driving mechanism individually moving the first moving member and the second moving member relative to the pump body such that the first moving member and the second moving member move at substantially equal speeds when the pump chamber is open to both the suction port and the discharge port.

9. The pump unit according to claim 8, wherein said first moving member comprises a first piston fixed to a driving shaft, and said second moving member comprises a second piston movably engaged with said driving shaft, said driving shaft comprising means for shifting said second piston between a piston first position and a piston second position in said cylindrical pump.

10. The pump according to claim 9, wherein said shifting means comprises a stopper fixed to one end of said driving shaft, said stopper shifting said second piston from said piston first position to said piston second position with said driving shaft, and wherein said shifting means further comprises said first piston, said first piston shifting said second piston from said piston second position to said piston first position with said driving shaft.

11. The pump unit according to claim 8, wherein the driving mechanism comprises:

first and second cam followers located on the first moving member and the second moving member, respectively;

first and second cams transmitting motion to a corresponding one of the first and second cam followers, respectively; and a single driving source for driving the first and second cams for controlled rotation.

12. The pump unit according to claim 8, wherein the driving mechanism comprises two driving sources driving the two moving members, respectively.

13. The pump unit according to claim 8, wherein said first moving member comprises a first piston coupled to a first driving shaft for reciprocating movement in said cylindrical pump body, and said second moving member comprises a second piston coupled to a second driving shaft for reciprocating movement in said cylindrical pump body, said first piston and said first driving shaft being movable relative to said second piston and said second driving shaft, the pump unit further comprising a single driving source coupled to said first and second driving shafts, said single driving source effecting said reciprocating movement of said first and second driving shafts.

14. The pump unit according to claim 13, further comprising:

a first cam follower attached to the first driving shaft;

a second cam follower attached to the second driving shaft; and at least one cam member transmitting motion to the first and second cam followers, respectively.

15. The pump unit according to claim 8, wherein said first moving member comprises a first piston fixed to a driving shaft, and said second moving member comprises a second piston movably engaged with said driving shaft, said driving shaft comprising means for shifting said second piston between a piston first position and a piston second position in said cylindrical pump, the pump unit further comprising:

a driving mechanism that drives said driving shaft between a shaft first position and a shaft second position; and a pair of photoelectric sensors that detects when said driving shaft is in said shaft first position and said shaft second position, respectively.

16. The pump unit according to claim 8, wherein the driving mechanism moves the first moving member and the second moving member such that a negative pressure is developed in the pump chamber immediately before the pump chamber is opened to the suction port, said negative pressure being suitable to draw fluid from the suction port into the pump chamber.

17. A method of operating a pump including a pump body, at least two moving members movably fitted in the pump body in a liquid-tight fashion, the at least two moving members forming a pump chamber therebetween, and a suction port and a discharge port formed in the pump body, the method comprising:

separating said two moving members to expand said pump chamber and to create a negative pressure in said pump chamber;

blocking said discharge port during said separating, thereby suctioning ink through said suction port;

shifting the separated two moving members at substantially equal speeds along substantially all of a distance between a position where the suction port communicates with the pump chamber to a position where the discharge port communicates with the pump chamber such that said suction port and said discharge port are open to the pump chamber at the same time; and converging said two moving members to contract said pump chamber while blocking said suction port, thereby discharging ink through said discharge port.

18. The method according to claim 17, further comprising driving said two moving members with a single driving source.

19. The method according to claim 17, wherein said converging step comprises converging said two moving members until a volume of said pump chamber is substantially zero.

20. The method according to claim 17, wherein said shifting step comprises shifting the separated two moving members at substantially a same speed, thereby maintaining said pump chamber in a substantially constant volume.

* * * * *